US011518163B2

(12) United States Patent
Hirai et al.

(10) Patent No.: US 11,518,163 B2
(45) Date of Patent: Dec. 6, 2022

(54) LIQUID EJECTING APPARATUS AND METHOD FOR ACTIVATING LIQUID EJECTING APPARATUS

(71) Applicant: SEIKO EPSON CORPORATION, Tokyo (JP)

(72) Inventors: Yasuaki Hirai, Shiojiri (JP); Yasuo Sunaga, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 20 days.

(21) Appl. No.: 17/104,635

(22) Filed: Nov. 25, 2020

(65) Prior Publication Data

US 2021/0162749 A1 Jun. 3, 2021

(30) Foreign Application Priority Data

Nov. 28, 2019 (JP) ..... JP2019-215080

(51) Int. Cl.
*B41J 2/165* (2006.01)
*B41J 2/125* (2006.01)
*B41J 2/175* (2006.01)

(52) U.S. Cl.
CPC ..... *B41J 2/125* (2013.01); *B41J 2/1652* (2013.01); *B41J 2/17566* (2013.01)

(58) Field of Classification Search
CPC ..... B41J 2/125; B41J 2/1652; B41J 2/16526; B41J 2/16532; B41J 2/17546; B41J 2/16517; B41J 2002/17569; B41J 29/13
See application file for complete search history.

(56) References Cited

U.S. PATENT DOCUMENTS

2007/0076030 A1* 4/2007 Izuo ..... B41J 2/165 347/9
2008/0266336 A1 10/2008 Maru et al.

FOREIGN PATENT DOCUMENTS

| | | | | |
|---|---|---|---|---|
| JP | 2000-099214 A | | 4/2000 | |
| JP | 2004230847 A | * | 8/2004 | ..... B41J 2/16517 |
| JP | 2008-290451 A | | 12/2008 | |
| JP | 2014-051005 A | | 3/2014 | |
| JP | 2014-108571 A | | 6/2014 | |
| JP | 2016-036941 A | | 3/2016 | |

* cited by examiner

*Primary Examiner* — Sharon Polk
(74) *Attorney, Agent, or Firm* — Workman Nydegger

(57) ABSTRACT

A liquid ejecting apparatus includes a printing portion and a control portion. The printing portion executes a printing operation including ejecting a liquid from a nozzle onto a medium. The control portion executes an initial operation upon supply of power and executes the printing operation in accordance with a print instruction. The initial operation and the printing operation include a common printing operation that is common to the initial operation and the printing operation. When the control portion does not receive the print instruction during execution of the initial operation, the control portion executes the initial operation including the common printing operation. When the control portion receives the print instruction during execution of the initial operation, the control portion omits the common printing operation from the initial operation.

9 Claims, 8 Drawing Sheets

LIQUID EJECTING APPARATUS AND METHOD FOR ACTIVATING LIQUID EJECTING APPARATUS

The present application is based on, and claims priority from JP Application Serial Number 2019-215080, filed Nov. 28, 2019, the disclosure of which is hereby incorporated by reference herein in its entirety.

BACKGROUND

1. Technical Field

The present disclosure relates to a liquid ejecting apparatus, such as a printer, and a method for activating the liquid ejecting apparatus.

2. Related Art

For example, as described in JP-A-2008-290451, there is a recording apparatus that is an example of a liquid ejecting apparatus that ejects ink from a recording head to print an image, a character, or the like. The ink is an example of a liquid. The recording apparatus executes an initial operation when power is supplied to the recording apparatus. Specifically, when an abnormality has occurred at the time of previous power-off, the recording apparatus executes the initial operation including an operation of detecting the amount of remaining ink. When an abnormality has not occurred at the time of the previous power-off, the recording apparatus executes the initial operation that does not include the operation of detecting the amount of remaining ink. The recording apparatus executes a recording operation after executing the initial operation.

The recording apparatus described in JP-A-2008-290451 omits the operation of detecting the amount of remaining ink in the initial operation only when power is normally cut off. Therefore, a reduction in a time period from the supply of power to the start of the recording operation is limited.

SUMMARY

To solve the foregoing problem, a liquid ejecting apparatus includes a printing portion and a control portion. The printing portion executes a printing operation including ejecting a liquid from a nozzle onto a medium. The control portion executes an initial operation upon supply of power and executes the printing operation in accordance with a print instruction. The initial operation and the printing operation include a common printing operation that is common to the initial operation and the printing operation. When the control portion does not receive the print instruction during execution of the initial operation, the control portion executes the initial operation including the common printing operation. When the control portion receives the print instruction during execution of the initial operation, the control portion omits the common printing operation from the initial operation.

To solve the foregoing problem, a method for activating a liquid ejecting apparatus that executes an initial operation upon supply of power is provided. The liquid ejecting apparatus includes a printing portion configured to execute, in accordance with a print instruction, a printing operation including ejecting a liquid from a nozzle onto a medium. The initial operation and the printing operation include a common printing operation that is common to the initial operation and the printing operation. The method includes executing the initial operation including the common printing operation when the print instruction is not received during execution of the initial operation, and omitting the common printing operation from the initial operation when the print instruction is received during execution of the initial operation.

DESCRIPTION OF EXEMPLARY EMBODIMENTS

Hereinafter, an embodiment of a liquid ejecting apparatus and a method for activating the liquid ejecting apparatus is described with reference to the drawings. The liquid ejecting apparatus is, for example, an ink jet printer that ejects ink onto a medium to print an image, a character, or the like. The medium is a paper sheet or the like. The ink is an example of a liquid.

Figure 1:
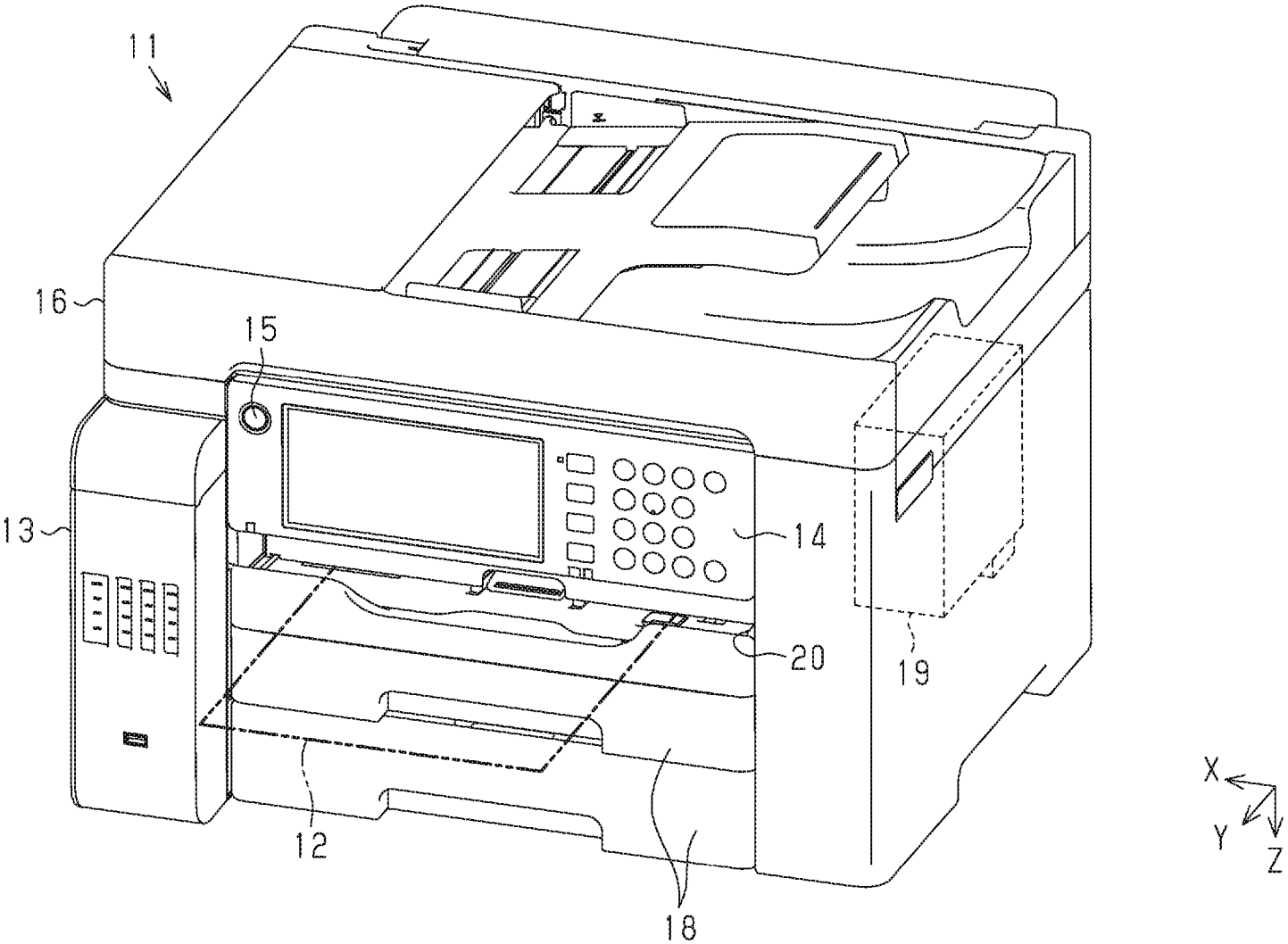
FIG. 1 is a perspective view of a liquid ejecting apparatus according to an embodiment.
Figure 2:
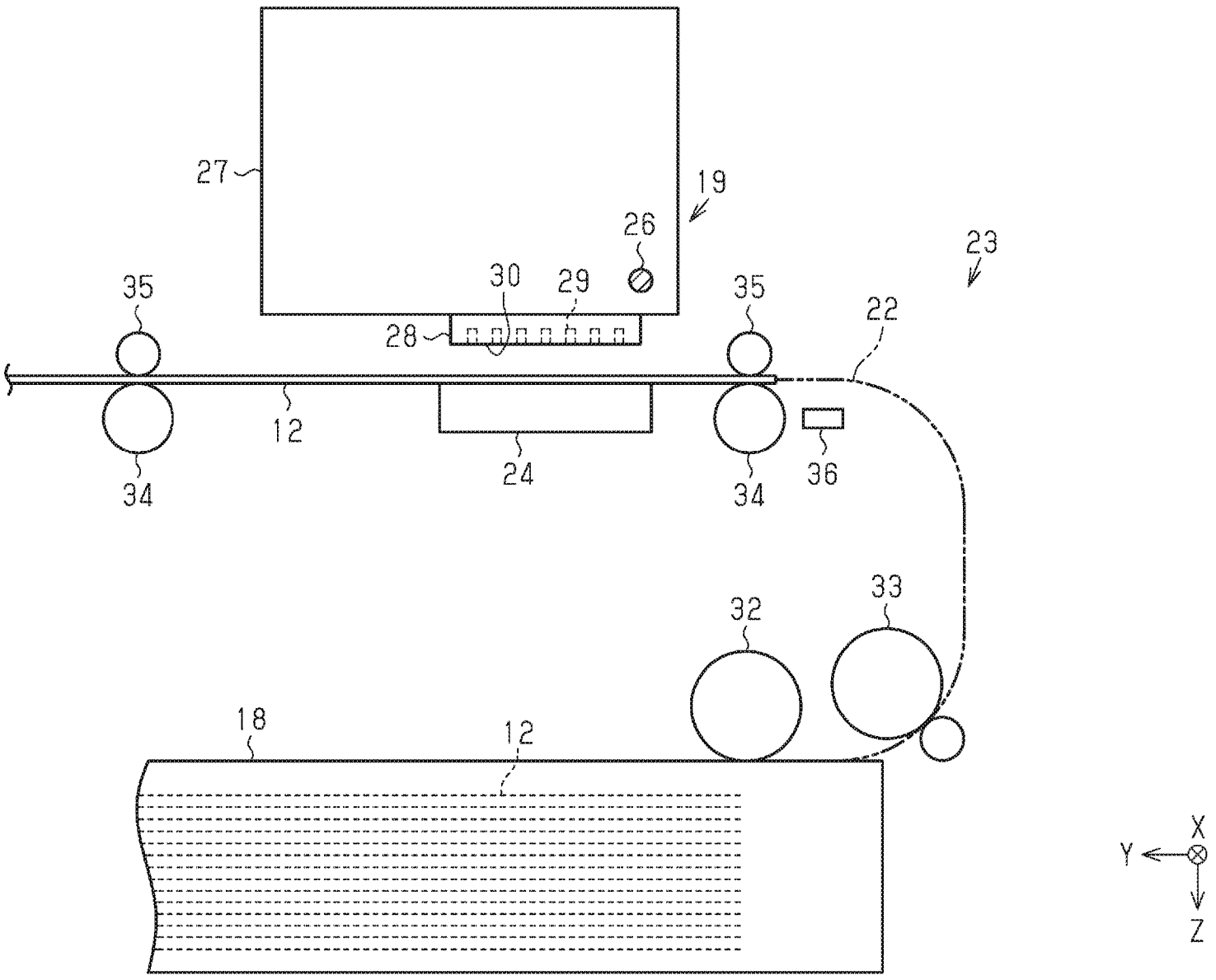
FIG. 2 is a schematic side view illustrating an internal configuration of the liquid ejecting apparatus.
Figure 3:
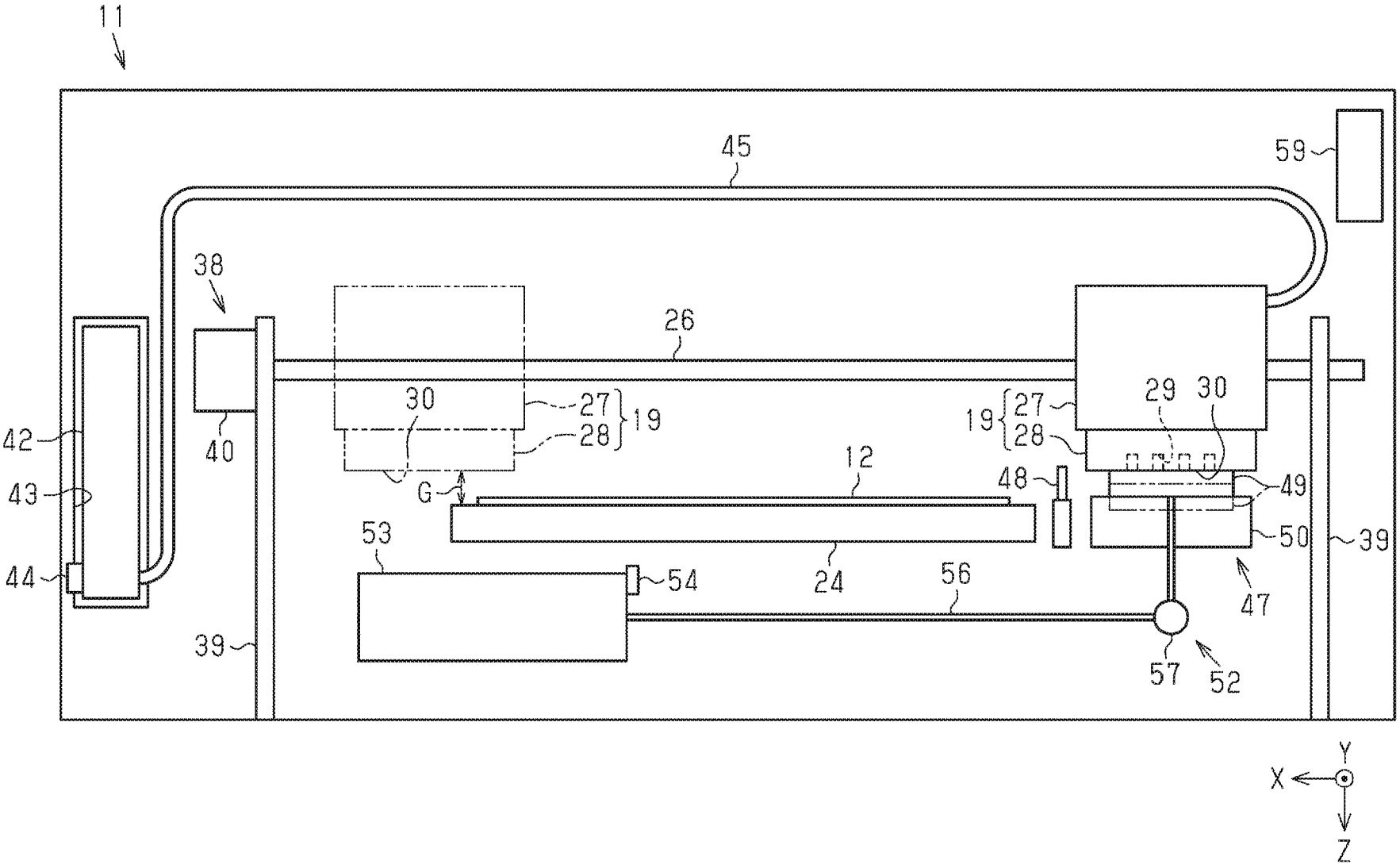
FIG. 3 is a schematic front view illustrating the internal configuration of the liquid ejecting apparatus.

FIGS. 1 to 3 illustrate a liquid ejecting apparatus 11 placed on a horizontal plane by using a Z axis indicating a direction of gravity and X and Y axes indicating directions parallel to the horizontal plane. The X, Y, and Z axes are perpendicular to each other.

As illustrated in FIG. 1, the liquid ejecting apparatus 11 includes a printing unit 13 and an operation unit 14. The printing unit 13 executes printing on a medium 12. The operation unit 14 is configured to perform various operations of the liquid ejecting apparatus 11. The operation unit 14 includes a power button 15 for supplying power to the liquid ejecting apparatus 11 and cutting off the power. The liquid ejecting apparatus 11 may include a reading unit 16 that reads an image of a document not illustrated.

A medium storage portion 18 may be attached to the liquid ejecting apparatus 11. The medium storage portion 18 is attachable to and detachable from the liquid ejecting apparatus 11 and configured to store a plurality of media 12. The liquid ejecting apparatus 11 includes a printing portion 19 and a discharging portion 20. The printing portion 19 executes printing on the medium 12 supplied from the medium storage portion 18, and the discharging portion 20 discharges the medium 12 on which the printing has been executed.

As illustrated in FIG. 2, the liquid ejecting apparatus 11 may include a transporting portion 23 and a medium holder 24. The transporting portion 23 transports the medium 12 along a transportation path 22 indicated by an alternate long and two short dashed line in FIG. 2, and the medium holder 24 holds the medium 12. The transporting portion 23 transports the medium 12 stored in the medium storage portion 18 toward the discharging portion 20 in a transportation direction in which the transportation path 22 for the medium 12 extends. The printing portion 19 executes the printing on the medium 12 transported by the transporting portion 23 and held by the medium holder 24.

The printing portion 19 includes a carriage 27 and a liquid ejector 28 mounted on the carriage 27. The carriage 27 can reciprocate along a guide shaft 26. The liquid ejector 28 has a nozzle formation surface 30 at which a plurality of nozzles 29 are formed. The printing portion 19 ejects a liquid from the nozzles 29 to print an image, a character, or the like on the medium 12 while moving along the guide shaft 26.

The transporting portion 23 may include a pickup roller 32 and a separation roller 33. The pickup roller 32 feeds the medium 12 located at the uppermost position among media 12 stacked in the medium storage portion 18. The separation roller 33 separates the media 12 fed by the pickup roller 32 from each other one by one. The transporting portion 23 may include a transport roller 34, a driven roller 35, and a rotation detector 36. The transport roller 34 transports the medium 12 along the transportation path 22. The driven roller 35 is driven and rotated so that the driven roller 35 and the transport roller 34 nip the medium 12 between the driven roller 35 and the transport roller 34. The rotation detector 36 detects rotation of the transport roller 34.

As illustrated in FIG. 3, the liquid ejecting apparatus 11 may include an adjuster 38 that adjusts the position of the nozzle formation surface 30 relative to the medium holder 24. The adjuster 38 may include a pair of shaft holders 39 and a cam mechanism 40. The shaft holders 39 hold the guide shaft 26 so that the guide shaft 26 is movable. The cam mechanism 40 moves the guide shaft 26.

The adjuster 38 changes a gap G that indicates the dimension of a gap between the liquid ejector 28 and the medium holder 24. Specifically, the adjuster 38 lowers the guide shaft 26 to cause the liquid ejector 28 to be closer to the medium holder 24 to reduce the gap G. The adjuster 38 raises the guide shaft 26 to cause the liquid ejector 28 to be farther from the medium holder 24 to increase the gap G.

The liquid ejecting apparatus 11 may include a mounting portion 43 and a liquid detector 44. A liquid storage portion 42 for storing a liquid to be supplied to the printing portion 19 is mounted in the mounting portion 43. The liquid detector 44 detects a state of the liquid storage portion 42 mounted in the mounting portion 43. The liquid ejecting apparatus 11 may include a supply path 45 through which the liquid stored in the liquid storage portion 42 is supplied to the liquid ejector 28. The supply path 45 may be a tube that is deformed as the carriage 27 moves. The liquid detector 44 may be a sensor that detects the amount of the liquid stored in the liquid storage portion 42.

The liquid storage portion 42 may be a replaceable cartridge or a tank having a fill port through which the liquid can be poured into the tank. When the liquid storage portion 42 is the tank and the fill port is positioned so that the liquid can be poured into the liquid storage portion 42 mounted in the mounting portion 43, the liquid storage portion 42 may be fixed to the mounting portion 43. When the liquid storage portion 42 is the cartridge, the mounting portion 43 may hold the liquid storage portion 42 so that the liquid storage portion 42 is attachable to and detachable from the mounting portion 43, and the liquid detector 44 may detect the liquid storage portion 42 mounted in the mounting portion 43. The liquid detector 44 may be a terminal capable of being electrically coupled to a storage portion included in the liquid storage portion 42. Specifically, the storage portion may store the amount of the liquid stored in the liquid storage portion 42, and the liquid detector 44 may acquire the liquid amount stored in the storage portion.

In the mounting portion 43, one or multiple liquid storage portions 42 may be mounted. When the one liquid storage portion 42 is mounted in the mounting portion 43, the liquid ejecting apparatus 11 may eject monochromatic ink supplied from the one liquid storage portion 42 to print a monochromatic image or the like. When the multiple liquid storage portions 42 are mounted in the mounting portion 43, the liquid storage portions 42 may store different types of liquids, respectively. For example, when the multiple liquid storage portions 42 store ink of different colors, such as cyan, magenta, yellow, and black, the liquid ejector 28 may eject the ink of the multiple colors that has been supplied from the liquid storage portions 42 to print a color image or the like.

The liquid ejecting apparatus 11 may include a cap portion 47 and a wiping portion 48. The cap portion 47 encloses the nozzles 29 and the wiping portion 48 wipes the nozzle formation surface 30. The cap portion 47 may include a cap 49 and a moving mechanism 50. The cap 49 comes in contact with the liquid ejector 28 and forms a closed space enclosing the nozzles 29. The moving mechanism 50 moves the cap 49. Specifically, the moving mechanism 50 moves the cap 49 to a capping position indicated by a solid line in FIG. 3 and a separated position indicated by an alternate long and two short dashes line in FIG. 3. At the capping position, the cap 49 can come in contact with the liquid ejector 28 positioned at a home position. At the separated position, the cap 49 is separated from the liquid ejector 28. The moving mechanism 50 according to the embodiment moves the cap 49 to the separated position by lowering the cap 49 from the capping position. The moving mechanism 50 moves the cap 49 to the capping position by raising the cap 49 from the separated position.

The cap 49 located at the capping position forms the closed space between the cap 49 and the nozzle formation surface 30. In the closed space, the nozzles 29 are opened. The cap 49 is moved from the capping position to the separated position to release the closed space between the cap 49 and the nozzle formation surface 30. In the embodiment, moving the cap 49 from the separated position to the capping position to form the closed space is referred to as "closing the cap 49" in some cases. In the embodiment, moving the cap 49 from the capping position to the separated position to release the closed space is referred to as "opening the cap 49" in some cases.

The liquid ejecting apparatus 11 may include a suction mechanism 52 that forcibly discharges the liquid from the printing portion 19. The liquid ejecting apparatus 11 may include a discharged liquid detector 54 that detects a state of a discharged liquid storage portion 53 for storing, as a discharged liquid, the liquid discharged from the printing portion 19. The discharged liquid detector 54 may be a sensor that detects the amount of the discharged liquid stored in the discharged liquid storage portion 53. For example, the discharged liquid storage portion 53 may be a replaceable cartridge or a tank fixed to the liquid ejecting apparatus 11. When the discharged liquid storage portion 53 is the cartridge, the discharged liquid detector 54 may detect that the discharged liquid storage portion 53 has been attached to the liquid ejecting apparatus 11. The discharged liquid detector 54 may be a terminal capable of being electrically coupled to a storage portion included in the discharged liquid storage portion 53. Specifically, the storage portion may store the amount of the discharged liquid stored in the discharged liquid storage portion 53, and the discharged liquid detector 54 may acquire the discharged liquid amount stored in the storage portion.

The suction mechanism 52 may include a discharge path 56 and a discharge pump 57. The discharge path 56 has an upstream end coupled to the cap 49. The discharge pump 57 is installed in the middle of the discharge path 56. The discharge path 56 may be a tube that is deformed as the cap 49 moves. The discharge path 56 has a downstream end coupled to the discharged liquid storage portion 53. The discharge pump 57 reduces the pressure in the closed space formed by the cap 49 via the discharge path 56 and forcibly discharges the liquid from the nozzles 29. The liquid discharged from the nozzles 29 is stored as the discharged liquid in the discharged storage portion 53. Maintenance to be executed to reduce the pressure in the closed space and discharge the liquid is also referred to as "suction cleaning".

The liquid ejecting apparatus 11 includes a control portion 59. The control portion 59 is, for example, a processing circuit including a computer and a memory, or the like. The control portion 59 controls various operations that are executed by the liquid ejecting apparatus 11 in accordance with a program stored in the memory.

Figure 5:
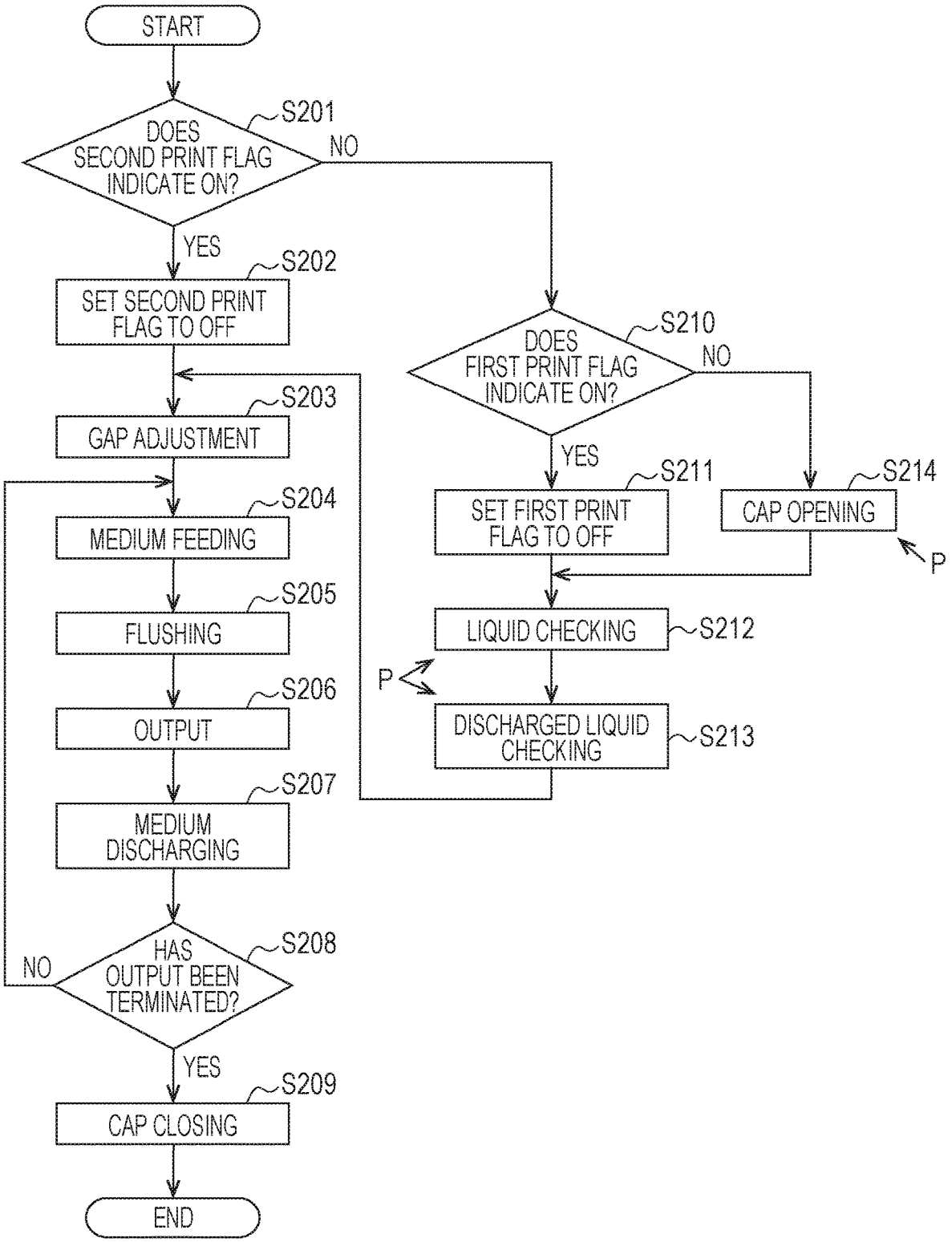
FIG. 5 is a flowchart illustrating a printing routine.
Figure 6:
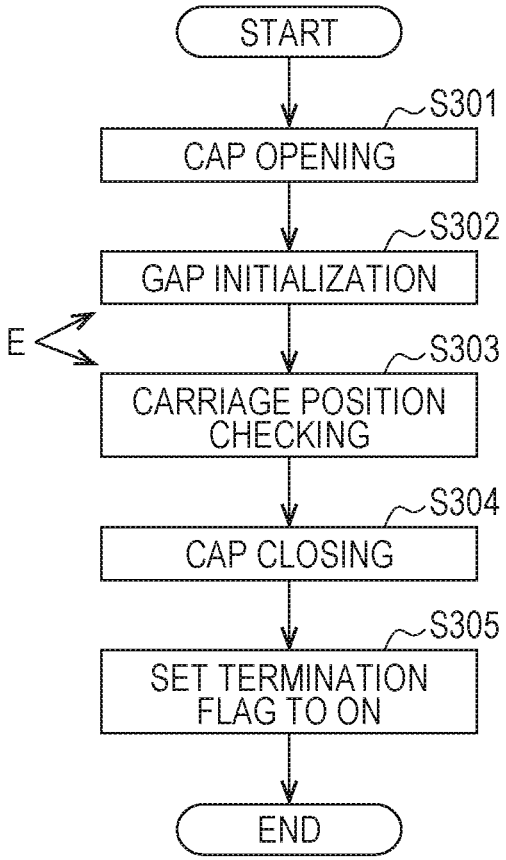
FIG. 6 is a flowchart illustrating a power-off routine.

A method for activating the liquid ejecting apparatus 11 is described with reference to FIGS. 4 to 6. In an initial state, a first print flag and a second print flag indicate OFF.

Figure 4:
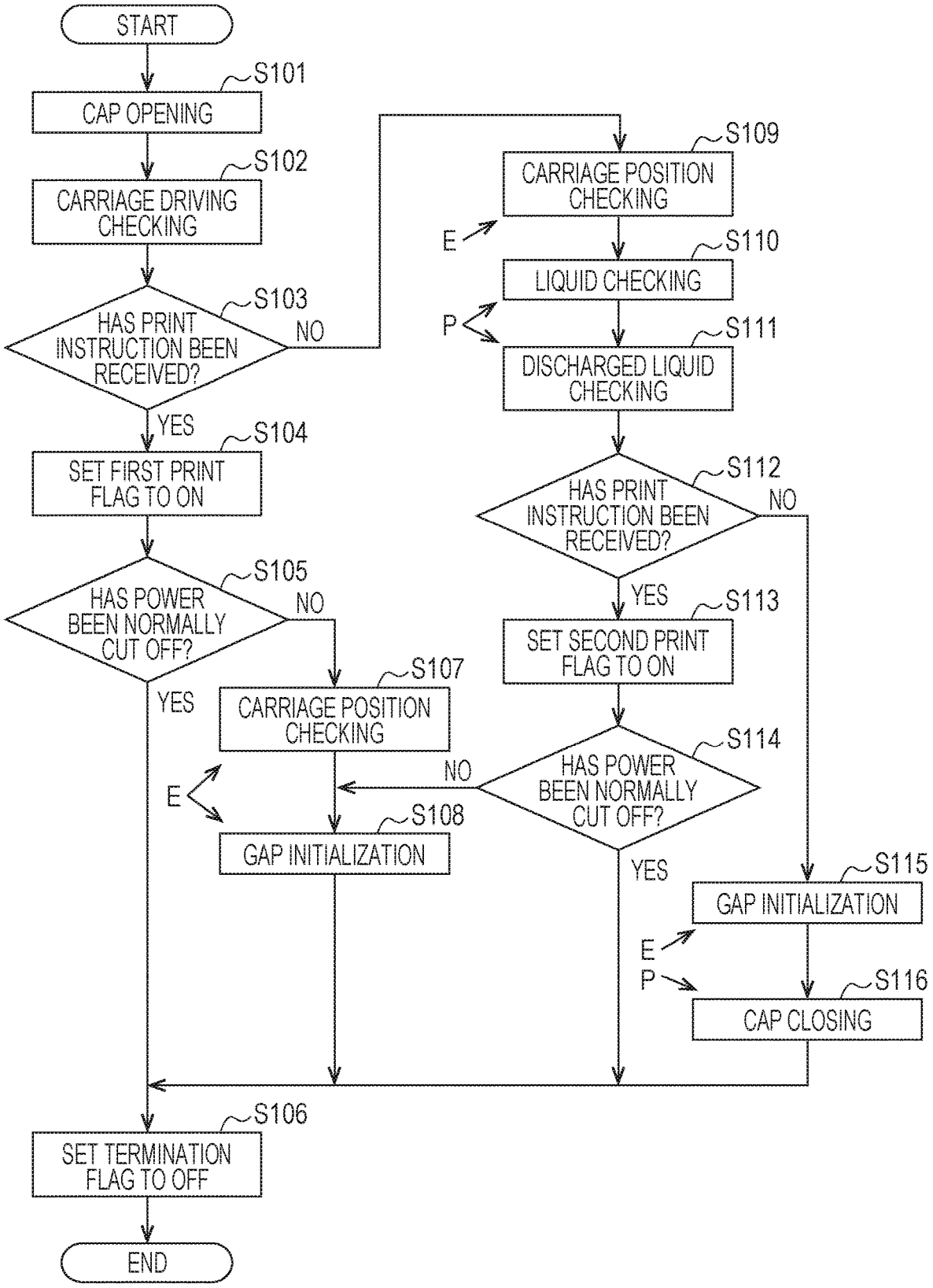
FIG. 4 is a flowchart illustrating an initial routine.

An initial routine illustrated in FIG. 4 is executed when the power button 15 of the liquid ejecting apparatus 11 is pressed and power is supplied to the liquid ejecting apparatus 11. In other words, the control portion 59 executes an initial operation according to the initial routine when the power is supplied to the liquid ejecting apparatus 11. The initial operation includes operations to be executed in the initial routine.

As illustrated in FIG. 4, in step S101, the control portion 59 executes a cap opening operation of moving the cap 49 from the capping position to the separated position to open the cap 49. When the cap 49 is separated from the liquid ejector 28, the liquid ejector 28 and the carriage 27 can move along the guide shaft 26.

In step S102, the control portion 59 executes a carriage driving checking operation of checking driving of the carriage 27. In the carriage driving checking operation, the control portion 59 moves the carriage 27 along the guide shaft 26 and checks that a foreign object, such as a medium 12, does not exist on a movement path for the carriage 27 and the liquid ejector 28.

In step S103, the control portion 59 determines whether the control portion 59 has received a print instruction. When the control portion 59 receives the print instruction within a time period from the supply of the power to the liquid ejecting apparatus 11 to the termination of the carriage driving checking operation, the answer to step S103 is YES and the control portion 59 causes a process illustrated in FIG. 4 to proceed to step S104. In step S104, the control portion 59 sets the first print flag to ON.

In step S105, the control portion 59 determines, based on whether a termination flag indicates ON or OFF, whether a power-off operation has been normally executed at the time of previous cutting-off of power to the liquid ejecting apparatus 11. In the embodiment, when the termination flag indicates ON, the control portion 59 determines that the previous power-off operation has been normally executed, the answer to step S105 is YES, and the control portion 59 causes the process to proceed to step S106. In step S106, the control portion 59 sets the termination flag to OFF and terminates the initial operation.

When the termination flag indicates OFF, the control portion 59 determines that the previous power-off operation has not been normally executed in step S105, the answer to step S105 is NO, and the control portion 59 causes the process to proceed to step S107. In step S107, the control portion 59 executes a carriage position checking operation of checking an origin position serving as a standard position for a movement of the carriage 27. The origin position may be the same position as the home position at which the nozzles 29 are covered with the cap 49 or may be set to a position different from the home position. In step S108, the control portion 59 executes a gap initialization operation of initializing the gap G. The gap initialization operation according to the embodiment is an operation of minimizing the gap G. After that, the control portion 59 causes the process to proceed to step S106.

When the control portion 59 determines that the control portion 59 has not received the print instruction in step S103, the answer to step S103 is NO and the control portion 59 causes the process to proceed to step S109. In step S109, the control portion 59 executes the carriage position checking operation in the same manner as step S107.

In step S110, the control portion 59 executes a liquid checking operation of checking the state of the liquid storage portion 42. For example, as the liquid checking operation, the control portion 59 checks, based on the result of the detection by the liquid detector 44, whether the liquid storage portion 42 can supply the liquid to the liquid ejector 28. When the amount of the liquid stored in the liquid storage portion 42 is not sufficient, and the liquid cannot be supplied from the liquid storage portion 42 to the liquid ejector 28, the control portion 59 may issue an error.

In step S111, the control portion 59 executes a discharged liquid checking operation of checking the state of the discharged liquid storage portion 53. For example, as the discharged liquid checking operation, the control portion 59 checks, based on the result of the detection by the discharged liquid detector 54, whether the discharged liquid storage portion 53 can receive a discharged liquid. The control portion 59 may calculate the amount of the discharged liquid stored in the discharged liquid storage portion 53 from the number of times that the suction cleaning has been executed. For example, when the amount of the discharged liquid stored in the discharged liquid storage portion 53 is equal to an allowable limit and the discharged liquid storage portion 53 cannot newly receive a discharged liquid, the control portion 59 may issue an error.

In step S112, the control portion 59 determines whether the control portion 59 has received the print instruction in the same manner as step S103. When the control portion 59 has received the print instruction, the answer to step S112 is YES and the control portion 59 causes the process to proceed to step S113. In step S113, the control portion 59 sets the second print flag to ON.

In step S114, the control portion 59 determines whether the previous power-off operation has been normally executed in the same manner as step S105. When the termination flag indicates ON, the control portion 59 determines that the previous power-off operation has been normally executed, the answer to step S114 is YES, and the control portion 59 causes the process to proceed to step S106. When the termination flag indicates OFF, the control portion 59 determines that the previous power-off operation has not been normally executed, the answer to step S114 is NO, and the control portion 59 causes the process to proceed to step S108.

When the control portion 59 has not received the print instruction in step S112, the answer to step S112 is NO and the control portion 59 causes the process to proceed to step S115. In step S115, the control portion 59 executes the gap initialization operation in the same manner as step S108. In step S116, the control portion 59 executes a cap closing operation of moving the cap 49 from the separated position to the capping position to close the cap 49. After that, the control portion 59 causes the process to proceed to step S106.

A printing routine is described with reference to a flowchart illustrated in FIG. 5. The printing routine is executed when the control portion 59 receives the print instruction. When the control portion 59 receives the print instruction during the initial operation, the control portion 59 executes the printing routine subsequent to the initial operation after the termination of the initial operation. In other words, the control portion 59 executes the printing operation according to the printing routine in accordance with the print instruction. The printing operation is an operation including ejecting the liquid from the nozzles 29 onto the medium 12. The control portion 59 drives the printing portion 19 and executes the printing operation. The printing operation includes operations to be executed in the printing routine.

In step S201, the control portion 59 determines whether the second print flag indicates ON. When the second print flag indicates ON, the answer to step S201 is YES and the control portion 59 causes a process illustrated in FIG. 5 to proceed to step S202. In step S202, the control portion 59 sets the second print flag to OFF.

In step S203, the control portion 59 executes a gap adjustment operation of adjusting the gap G based on, for example, a thickness of the medium 12. In step S204, the control portion 59 executes a medium feeding operation of feeding the medium 12 stored in the medium storage portion 18 to the transportation path 22. In step S205, the control portion 59 executes a flushing operation of ejecting the liquid from the nozzles 29, regardless of the printing. In the embodiment, the control portion 59 executes the flushing operation to eject the liquid toward the cap 49 located at the separated position.

In step S206, the control portion 59 executes an output operation of ejecting the liquid from the nozzles 29 to output a character, an image, or the like to the medium 12. Specifically, the output operation includes an ejection operation of ejecting the liquid from the nozzles 29 onto the medium 12 while moving the carriage 27 and a transportation operation of transporting the medium 12. As the output operation, the control portion 59 alternately executes the ejection operation and the transportation operation. In step S207, the control portion 59 executes a medium discharging operation of discharging, from the discharging portion 20, the medium 12 on which the output operation has been executed.

In step S208, the control portion 59 determines whether the output operation has been completely executed in accordance with the print instruction. When the output operation has not been completely executed, the answer to step S208 is NO and the control portion 59 causes the process to proceed to step S204. In step S204, the control portion 59 feeds a next medium 12 from the medium storage portion 18. When the output operation has been completely executed, the answer to step s208 is YES and the control portion 59 causes the process to proceed to step S209. In step S209, the control portion 59 executes the cap closing operation of closing the cap 49 and terminates the printing routine.

When the second print flag indicates OFF in step S201, the answer to step S201 is NO and the control portion 59 causes the process to proceed to step S210. In step S210, the control portion 59 determines whether the first print flag indicates ON. When the first print flag indicates ON, the answer to step S210 is YES and the control portion 59 causes the process to proceed to step S211. In step S211, the control portion 59 sets the first print flag to OFF.

In step S212, the control portion 59 executes the liquid checking operation. In step S213, the control portion 59 executes the discharged liquid checking operation and causes the process to proceed to step S203.

When the first print flag indicates OFF in step S210, the answer to step S210 is NO and the control portion 59 causes the process to proceed to step S214. In step S214, the control portion 59 executes the cap opening operation of opening the cap 49 and causes the process to proceed to step S212.

Next, a power-off routine is described with reference to a flowchart illustrated in FIG. 6. The power-off routine is executed when the power button 15 of the liquid ejecting apparatus 11 is pressed and power to the liquid ejecting apparatus 11 is cut off. In other words, the control portion 59 executes the power-off operation in accordance with the power-off routine and cuts off the power to the liquid ejecting apparatus 11. The power-off operation includes operations to be executed in the power-off routine.

In step S301, the control portion 59 executes the cap opening operation. In step S302, the control portion 59 executes the gap initialization operation. In step S303, the control portion 59 executes the carriage position checking operation. In step S304, the control portion 59 executes the cap closing operation. In step S305, the control portion 59 sets the termination flag to ON and terminates the power-off routine.

Effects of the embodiment are described below.

The initial operation and the printing operation include a common printing operation P that is common to the initial operation and the printing operation. The common printing operation P may include a cap operation, the liquid checking operation, and the discharged liquid checking operation.

Specifically, among the operations included in the initial operation, the liquid checking operation to be executed in step S110, the discharged liquid checking operation to be executed in step S111, and the cap closing operation to be executed in step S116 are included in the common printing operation P. Among the operations included in the printing operation, the liquid checking operation to be executed in step S212, the discharged liquid checking operation to be executed in step S213, and the cap opening operation to be executed in step S214 are included in the common printing operation P.

The cap closing operation of step S116 and the cap opening operation of step S214 are the cap operation of driving the cap portion 47. The control portion 59 executes the cap closing operation of closing the cap 49 in the initial operation and executes the cap opening operation of opening the cap 49 in the printing operation. The cap opening operation is paired with the cap closing operation.

The liquid checking operation of step S110 included in the initial operation is the same as the liquid checking operation of step S212 included in the printing operation. The discharged liquid checking operation of step S111 included in the initial operation is the same as the discharged liquid checking operation of step S213 included in the printing operation.

The initial operation and the power-off operation include a common power-off operation E that is common to the initial operation and the power-off operation. The common power-off operation E may include the carriage position checking operation and the gap initialization operation.

Specifically, among the operations included in the initial operation, the carriage position checking operation to be executed in steps S107 and S109 and the gap initialization operation to be executed in steps S108 and S115 are included in the common power-off operation E. Among the operations included in the power-off operation, the gap initialization operation to be executed in step S302 and the carriage position checking operation to be executed in step S303 are included in the common power-off operation E.

The carriage position checking operation of steps S107 and S109 included in the initial operation is the same as the carriage position checking operation of step S303 included in the power-off operation. The gat initialization operation of steps S108 and S115 included in the initial operation is the same as the gap initialization operation of step S302 included in the power-off operation.

When the power button 15 is pressed in a state in which power is cut off, the control portion 59 executes the initial operation. When the control portion 59 does not receive the print instruction during the execution of the initial operation, the control portion 59 executes the initial operation including the common printing operation P and the common power-off operation E. Specifically, as the initial operation, the control portion 59 according to the embodiment executes the cap opening operation, the carriage driving checking operation, the carriage position checking operation, the liquid checking operation, the discharged liquid checking operation, the gap initialization operation, and the cap closing operation in this order. In other words, the normal initial operation includes the cap opening operation, the carriage driving checking operation, the carriage position checking operation, the liquid checking operation, the discharged liquid checking operation, the gap initialization operation, and the cap closing operation.

When the control portion 59 receives the print instruction after the termination of the initial operation, the control portion 59 executes the printing operation. When the control portion 59 receives the print instruction after the termination of the initial operation, the first print flag and the second print flag indicate OFF. As the printing operation, the control portion 59 according to the embodiment executes the cap opening operation, the liquid checking operation, the discharged liquid checking operation, the gap adjustment operation, the medium feeding operation, the flushing operation, the output operation, and the medium discharging operation in this order. In other words, the normal printing operation includes the cap opening operation, the liquid checking operation, the discharged liquid checking operation, the gap adjustment operation, the medium feeding operation, the flushing operation, the output operation, and the medium discharging operation.

When the power button 15 is pressed in a state in which power is supplied to the liquid ejecting apparatus 11, the control portion 59 executes the power-off operation and then cuts off the power. As the power-off operation, the control portion 59 according to the embodiment executes the cap opening operation, the gap initialization operation, the carriage position checking operation, and the cap closing operation in this order. In other words, the normal power-off operation includes the cap opening operation, the gap initialization operation, the carriage position checking operation, and the cap closing operation.

The control portion 59 sets the termination flag to ON, terminates the power-off operation, and cuts off the power. Therefore, when the termination flag indicates ON, the gap G is already initialized and the control portion 59 has, stored therein, the position of the carriage 27 relative to the origin position at the time of the cutting-off of the power.

Therefore, when the power-off operation is normally executed, and thereafter the power button 15 is pressed again, and power is supplied to the liquid ejecting apparatus 11, the liquid ejector 28 is in the same state as that after the execution of the gap initialization operation and the carriage position checking operation. Therefore, when the previous power-off operation is normally executed and the control portion 59 receives the print instruction during the execution of the initial operation, the control portion 59 omits the common printing operation P and the common power-off operation E from the initial operation.

In the embodiment, the control portion 59 checks whether the control portion 59 has received the print instruction during the initial operation a plurality of times. When the control portion 59 receives the print instruction after executing the common printing operation P and the common power-off operation E, the control portion 59 executes the initial operation including the common printing operation P already executed and the common power-off operation E already executed. When the common printing operation P and the common power-off operation E are included in the initial operation that is executed after the reception of the print instruction, the control portion 59 omits, from the initial operation, the common printing operation P and the common power-off operation E that have not yet been executed.

For example, when power is normally cut off and the control portion 59 receives the print instruction within a time period from the start of the initial operation to the execution of the cap opening operation and the carriage driving checking operation, the initial operation executed by the control portion 59 is a first reduced initial operation obtained by omitting the common printing operation P and the common power-off operation E from the initial operation. The first reduced initial operation is executed when the answer to step S103 illustrated in FIG. 4 is YES. The first reduced initial operation includes the cap opening operation and the carriage driving checking operation. Specifically, the first reduced initial operation is obtained by omitting the carriage position checking operation, the liquid checking operation, the discharged liquid checking operation, the gap initialization operation, and the cap closing operation from the normal initial operation.

When the first reduced initial operation is to be executed as the initial operation, the first print flag indicates ON and the second print flag indicates OFF. Therefore, the printing operation to be executed after the initial operation is a first reduced printing operation obtained by omitting the cap opening operation from the normal printing operation.

For example, when the control portion 59 does not receive the print instruction within a time period from the start of the initial operation to the execution of the carriage driving checking operation and receives the print instruction during the execution of the carriage position checking operation, the liquid checking operation, and the discharged liquid checking operation, the initial operation executed by the control portion 59 is a second reduced initial operation. The second reduced initial operation is executed when the answer to step S103 illustrated in FIG. 4 is NO and the answer to step S112 is YES. The second reduced initial operation includes the cap opening operation, the carriage driving checking operation, the carriage position checking operation, the liquid checking operation, and the discharged liquid checking operation. Specifically, the second reduced initial operation is obtained by omitting the gap initialization operation and the cap closing operation from the normal initial operation.

When the second reduced initial operation is to be executed as the initial operation, the first print flag indicates OFF and the second print flag indicates ON. Therefore, the printing operation to be executed after the initial operation is a second reduced printing operation obtained by omitting the cap opening operation, the liquid checking operation, and the discharged liquid checking operation from the normal printing operation.

When the power-off operation is not normally executed and when a plug (not illustrated) of the liquid ejecting apparatus 11 is unplugged within a time period for which power is cut off so that the supply of power is stopped, the termination flag is set to OFF. When the control portion 59 receives the print instruction during the initial operation executed in a state in which the termination flag indicates OFF, the initial operation executed by the control portion 59 is a third or fourth reduced initial operation that includes the common power-off operation E and that does not include the common printing operation P.

The third reduced initial operation is executed when the answer to step S103 illustrated in FIG. 4 is YES and the answer to step S105 is NO. Specifically, the third reduced initial operation includes the cap opening operation, the carriage driving checking operation, the carriage position checking operation, and the gap initialization operation. The printing operation to be executed after the third reduced initial operation is the first reduced printing operation.

The fourth reduced initial operation is executed when the answer to step S103 illustrated in FIG. 4 is NO, the answer to step S112 is YES, and the answer to step S114 is NO. Specifically, the fourth reduced initial operation includes the cap opening operation, the carriage driving checking operation, the carriage position checking operation, the liquid checking operation, the discharged liquid checking operation, and the gap initialization operation. The printing operation to be executed after the fourth reduced initial operation is the second reduced printing operation.

Effects of the embodiment are described below.

(1) When the control portion 59 receives the print instruction during the execution of the initial operation, the control portion 59 omits the common printing operation P that is common to the initial operation and the printing operation. Specifically, in the case where the control portion 59 sequentially executes the initial operation and the printing operation, the control portion 59 can omit the common printing operation P from the initial operation and reduce a time period for the initial operation.

(2) The power-off operation includes the common power-off operation E. Therefore, when the power-off operation is normally executed to cut off power, and power is supplied to the liquid ejecting apparatus 11 after the cutting-off, the liquid ejecting apparatus 11 is in a state in which the common power-off operation E has been executed. When the control portion 59 receives the print instruction during the execution of the initial operation after the power-off operation is normally executed, the control portion 59 omits not only the common printing operation P but also the common power-off operation E. It is, therefore, possible to reduce a time period required for the initial operation while suppressing a reduction in the quality of the printing.

(3) The control portion 59 executes the initial operation that includes the common printing operation P before the reception of the print instruction and that does not include the common printing operation P to be executed after the reception of the print instruction. Therefore, the control portion 59 can omit the common printing operation P in accordance with the timing of receiving the print instruction.

(4) The control portion 59 executes the initial operation that includes the common power-off operation E before the reception of the print instruction and that does not include the common power-off operation E to be executed after the reception of the print instruction. Therefore, the control portion 59 can omit the common power-off operation E in accordance with the timing of receiving the print instruction.

(5) The common printing operation P that is common to the initial operation and the printing operation includes the cap operation of driving the cap portion 47. Specifically, the initial operation includes the cap closing operation that is a cap operation of driving the cap portion 47 and forming the closed space in which the nozzles 29 are opened. The printing operation includes the cap opening operation that is a cap operation of driving the cap portion 47 and releasing the closed space in which the nozzles 29 are opened. Therefore, in the case where the control portion 59 sequentially executes the initial operation and the printing operation, the control portion 59 omits the cap closing operation from the initial operation, does not need to execute the cap opening operation in the printing operation, and can reduce a time period from the supply of power to the start of the ejection of the liquid onto the medium 12.

(6) The common printing operation P that is common to the initial operation and the printing operation includes the liquid checking operation. Specifically, by omitting, from the initial operation, the liquid checking operation that is also executed in the printing operation, it is possible to reduce a time period for the initial operation while suppressing a reduction in the quality of the printing.

(7) The common printing operation P that is common to the initial operation and the printing operation includes the discharged liquid checking operation. Specifically, by omitting, from the initial operation, the discharged liquid checking operation that is also executed in the printing operation, it is possible to reduce a time period for the initial operation while reducing the probability that the discharged liquid leaks.

The embodiment can be modified and implemented as follows. The embodiment and the following modifications can be combined and implemented without technical contradiction.

Figure 7:
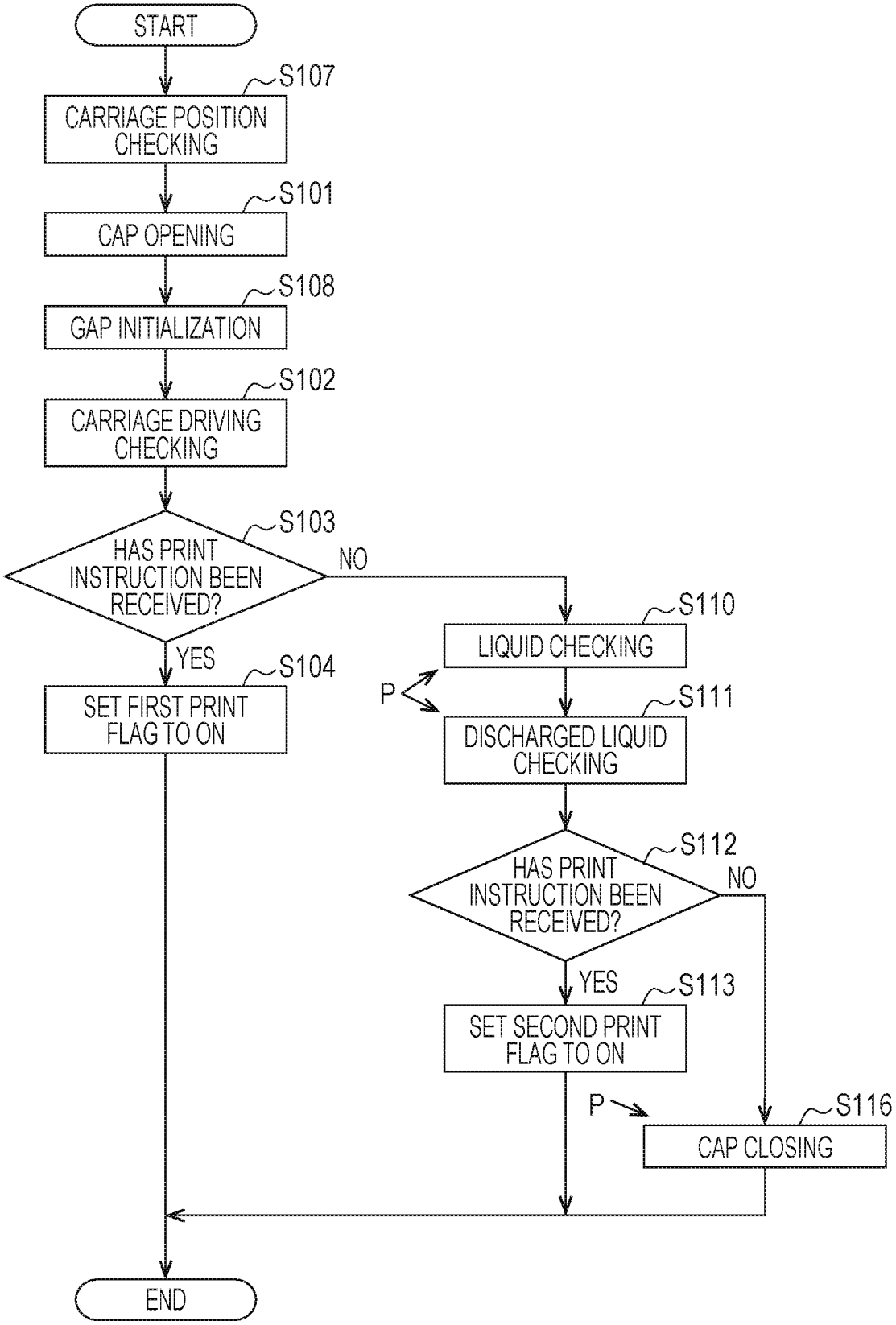
FIG. 7 is a flowchart illustrating a first modified initial routine.

The control portion 59 may execute the initial operation in accordance with a first modified initial routine illustrated in FIG. 7. The control portion 59 may execute the carriage position checking operation and the gap initialization operation, regardless of whether power has been normally cut off. The control portion 59 may execute the carriage position checking operation and the gap initialization operation before checking whether the control portion 59 has received the print instruction. Specifically, the control portion 59 may execute the carriage position checking operation of step S107 and the gap initialization operation of step S108 before step S103 and may omit steps S105 and S114. When the carriage position checking operation is to be executed before the cap opening operation, the carriage position checking operation may be executed in a state in which the cap 49 is closed. When the control portion 59 does not receive the print instruction during the execution of the initial operation, the control portion 59 executes, as the normal initial operation, the carriage position checking operation, the cap opening operation, the gap initialization operation, the carriage driving checking operation, the liquid checking operation, the discharged liquid checking operation, and the cap closing operation in this order. When the control portion 59 receives the print instruction before step S103, the control portion 59 omits, from the normal initial operation, the liquid checking operation, the discharged liquid checking operation, and the cap closing operation that are included in the common printing operation P. Specifically, the control portion 59 executes, as the initial operation, the carriage position checking operation, the cap opening operation, the gap initialization operation, and the carriage driving checking operation. When the control portion 59 does not receive the print instruction before step S103 and receives the print instruction before step S112, the control portion 59 executes the initial operation that includes the liquid checking operation already executed and the discharged liquid checking operation already executed and that does not include the cap closing operation not yet executed. Specifically, the control portion 59 executes, as the initial operation, the carriage position checking operation, the cap opening operation, the gap initialization operation, the carriage driving checking operation, the liquid checking operation, and the discharged liquid checking operation.

Figure 8:
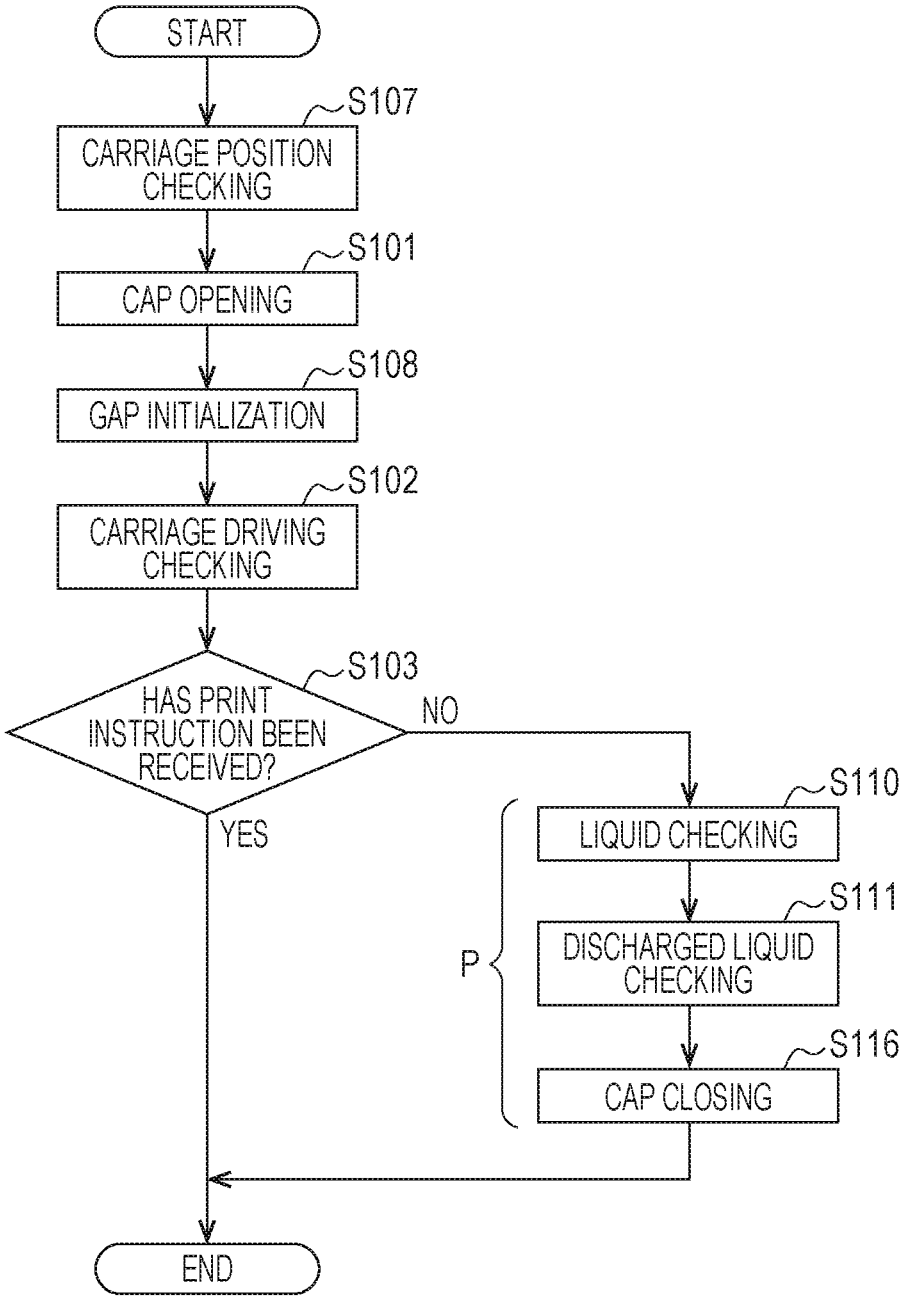
FIG. 8 is a flowchart illustrating a second modified initial routine.

The control portion 59 may execute the initial operation in accordance with a second modified initial routine illustrated in FIG. 8. The control portion 59 may execute the carriage position checking operation and the gap initialization operation, regardless of whether power has been normally cut off. The number of times that the control portion 59 checks whether the control portion 59 has received the print instruction in the initial operation may be one. The initial operation may not include the common printing operation P before the reception of the print instruction. When the control portion 59 does not receive the print instruction during the execution of the initial operation, the control portion 59 executes, as the initial operation including the common printing operation P, the carriage position checking operation, the cap opening operation, the gap initialization operation, the carriage driving checking operation, the liquid checking operation, the discharged liquid checking operation, and the cap closing operation. When the control portion 59 receives the print instruction during the execution of the initial operation, the control portion 59 omits the common printing operation P from the initial operation and executes the carriage position checking operation, the cap opening operation, the gap initialization operation, and the carriage driving checking operation.

The common printing operation P may include one or two of the cap operation, the liquid checking operation, and the discharged liquid checking operation. The common printing operation P may not include the cap operation, the liquid checking operation, and the discharged liquid checking operation. For example, the initial operation may include the flushing operation as the common printing operation P. The initial operation and the printing operation may include, as the common printing operation P, a cleaning operation of causing the suction mechanism 52 to execute the suction cleaning. The initial operation and the printing operation may include, as the common printing operation P, a transportation initialization operation of initializing the phase of the transport roller 34 based on the result of detection by the rotation detector 36.

The common power-off operation E may include one of the carriage position checking operation and the gap initialization operation. The common power-off operation E may not include the carriage position checking operation and the gap initialization operation. For example, the initial operation and the power-off operation may include the transportation initialization operation as the common power-off operation E.

The liquid ejecting apparatus 11 may spray and eject a liquid other than ink. The liquid to be ejected as a minute amount of liquid droplets from the liquid ejecting apparatus may be in a granular state, a droplet state, or a thread-like state. The liquid described herein may be a material as long as the material can be ejected from the liquid ejecting apparatus. For example, the liquid may be a substance as long as the substance is in a liquid phase. The liquid may include a fluid, such as a high-viscosity fluid, a low-viscosity fluid, a sol, gel water, another inorganic solvent, an organic solvent, a solution, liquid resin, liquid metal, or a metal melt. The liquid may not be limited to one state of a substance and may include a substance obtained by dissolving, dispersing, or mixing particles of a functional material of a solid object, such as a pigment or metal particles, in a solvent. Representative examples of the liquid are ink described in the embodiment and liquid crystals. The ink described herein may be one or more of various liquid compositions, such as general aqueous ink, general oil-based ink, gel ink, and hot melt ink. A specific example of the liquid ejecting apparatus is an apparatus that ejects a liquid containing a material in a dispersed or dissolved state. Examples of the material are an electrode material and a color material that are used to manufacture a liquid crystal display, an electroluminescence display, a surface-emitting display, a color filter, and the like. The liquid ejecting apparatus may be an apparatus that ejects a bioorganic substance to be used to manufacture a biochip. The liquid ejecting apparatus may be an apparatus that is used as a precision pipette and ejects a liquid serving as a specimen. The liquid ejecting apparatus may be a printing apparatus, a micro-dispenser, or the like. The liquid ejecting apparatus may be an apparatus that ejects a lubricant onto a precision device with precision. The precision device is a clock, a camera, or the like. The liquid ejecting apparatus may be an apparatus that ejects a transparent resin liquid, such as an ultraviolet curable resin liquid, onto a substrate in order to form a micro-hemisphere lens, an optical lens, or the like that is used for an optical communication element or the like. The liquid ejecting apparatus may be an apparatus that ejects an acid etching liquid, an alkaline etching liquid, or the like in order to etch a substrate or the like.

Technical ideas recognized from the foregoing embodiment and the foregoing modifications and effects of the embodiment and the modifications are described below.

(A) A liquid ejecting apparatus includes a printing portion and a control portion. The printing portion executes a printing operation including ejecting a liquid from a nozzle onto a medium. The control portion executes an initial operation upon supply of power and executes the printing operation in accordance with a print instruction. The initial operation and the printing operation include a common printing operation that is common to the initial operation and the printing operation. When the control portion does not receive the print instruction during execution of the initial operation, the control portion executes the initial operation including the common printing operation. When the control portion receives the print instruction during execution of the initial operation, the control portion omits the common printing operation from the initial operation.

According to the foregoing configuration, when the control portion receives the print instruction during the execution of the initial operation, the control portion omits the common printing operation that is common to the initial operation and the printing operation. Specifically, in the case where the control portion sequentially executes the initial operation and the printing operation, the control portion can omit the common printing operation from the initial operation and reduce a time period for the initial operation.

(B) In the liquid ejecting apparatus, the control portion may execute a power-off operation and then cut off the power. The initial operation and the power-off operation may include a common power-off operation that is common to the initial operation and the power-off operation. When the power-off operation is normally executed last time and the control portion receives the print instruction during execution of the initial operation, the control portion may omit the common printing operation and the common power-off operation from the initial operation.

According to the foregoing configuration, the power-off operation includes the common power-off operation. Therefore, when the power-off operation is normally executed to cut off the power, and power is supplied after the cutting-off, the liquid ejecting apparatus is in a state in which the common power-off operation has been executed. When the control portion receives the print instruction during the execution of the initial operation after the power-off operation is normally executed, the control portion omits not only the common printing operation but also the common power-off operation. It is, therefore, possible to reduce a time period required for the initial operation while suppressing a reduction in the quality of printing.

(C) In the liquid ejecting apparatus, when the common printing operation is included in the initial operation that is executed after reception of the print instruction, the control portion may omit the common printing operation from the initial operation. When the control portion receives the print instruction after executing the common printing operation, the control portion may execute the initial operation including the common printing operation.

According to the foregoing configuration, the control portion executes the initial operation that includes the common printing operation before the reception of the print instruction and that does not include the common printing operation to be executed after the reception of the print instruction. Therefore, the control portion can omit the common printing operation in accordance with the timing of receiving the print instruction.

(D) In the liquid ejecting apparatus, when the common power-off operation is included in the initial operation that is executed after reception of the print instruction, the control portion may omit the common power-off operation from the initial operation. When the control portion receives the print instruction after executing the common power-off operation, the control portion may execute the initial operation including the common power-off operation.

According to the foregoing configuration, the control portion executes the initial operation that includes the common power-off operation before the reception of the print instruction and that does not include the common power-off operation to be executed after the reception of the print instruction. Therefore, the control portion can omit the common power-off operation in accordance with the timing of receiving the print instruction.

(E) The liquid ejecting apparatus may include a cap portion that forms a closed space in which the nozzle is opened, and the common printing operation may include a cap operation of driving the cap portion.

According to the foregoing configuration, the common printing operation that is common to the initial operation and the printing operation includes the cap operation of driving the cap portion. Specifically, the initial operation includes a cap operation of driving the cap portion and forming the closed space in which the nozzle is opened. The printing operation includes a cap operation of driving the cap portion and releasing the space in which the nozzle is opened. Therefore, in the case where the control portion sequentially executes the initial operation and the printing operation, the control portion omits the cap operation from the initial operation, does not need to execute the cap operation in the printing operation, and can reduce a time period from the supply of power to the start of the ejection of the liquid onto the medium.

(F) In the liquid ejecting apparatus, the common printing operation may include a liquid checking operation of checking a state of a liquid storage portion for storing the liquid to be supplied to the printing portion.

According to the foregoing configuration, the common printing operation that is common to the initial operation and the printing operation includes the liquid checking operation. Specifically, by omitting, from the initial operation, the liquid checking operation that is also executed in the printing operation, it is possible to reduce a time period for the initial operation while suppressing a reduction in the quality of printing.

(G) In the liquid ejecting apparatus, the common printing operation may include a discharged liquid checking operation of checking a state of a discharged liquid storage portion for storing, as a discharged liquid, the liquid discharged from the printing portion.

According to the foregoing configuration, the common printing operation that is common to the initial operation and the printing operation includes the discharged liquid configuration operation. Specifically, by omitting, from the initial operation, the discharged liquid checking operation that is also executed in the printing operation, it is possible to reduce a time period for the initial operation while reducing the probability that the discharged liquid leaks.

(H) A method for activating a liquid ejecting apparatus that executes an initial operation upon supply of power is provided. The liquid ejecting apparatus includes a printing portion configured to execute, in accordance with a print instruction, a printing operation including ejecting a liquid from a nozzle onto a medium. The initial operation and the printing operation include a common printing operation that is common to the initial operation and the printing operation. The method includes executing the initial operation including the common printing operation when the print instruction is not received during execution of the initial operation, and omitting the common printing operation from the initial operation when the print instruction is received during execution of the initial operation.

According to the foregoing method, effects that are the same as or similar to those obtained by the foregoing liquid ejecting apparatus can be obtained.

What is claimed is:

1. A liquid ejecting apparatus comprising:

a printing portion that ejects a liquid from a nozzle onto a medium during a printing operation; and a control portion that executes an initial operation upon supply of power and executes the printing operation upon receipt of a print instruction, the print instruction causing the control portion to cause the printing portion to eject the liquid, wherein the initial operation and the printing operation include a common printing operation that is common to the initial operation and the printing operation, the common printing operation including one or more liquid checking operations, when the control portion does not receive the print instruction during execution of the initial operation, the control portion executes the initial operation including the common printing operation, when the control portion receives the print instruction during execution of the initial operation, the control portion omits the common printing operation from the initial operation, and the common printing operation is subsequently performed when the printing operation is performed.

2. The liquid ejecting apparatus according to claim 1, wherein the control portion executes a power-off operation and then cuts off the power, the initial operation and the power-off operation include a common power-off operation that is common to the initial operation and the power-off operation, and when the power-off operation is normally executed last time and the control portion receives the print instruction during execution of the initial operation, the control portion omits the common printing operation and the common power-off operation from the initial operation.

3. The liquid ejecting apparatus according to claim 2, wherein when the common power-off operation is included in the initial operation that is executed after reception of the print instruction, the control portion omits the common power-off operation from the initial operation, and when the control portion receives the print instruction after executing the common power-off operation, the control portion executes the initial operation including the common power-off operation.

4. The liquid ejecting apparatus according to claim 1, wherein when the common printing operation is included in the initial operation that is executed after reception of the print instruction, the control portion omits the common printing operation from the initial operation, and when the control portion receives the print instruction after executing the common printing operation, the control portion executes the initial operation including the common printing operation.

5. The liquid ejecting apparatus according to claim 1, further comprising:

a cap portion that forms a closed space in which the nozzle is opened, wherein the common printing operation includes a cap operation of driving the cap portion.

6. The liquid ejecting apparatus according to claim 1, wherein the common printing operation includes a liquid checking operation of checking a state of a liquid storage portion for storing the liquid to be supplied to the printing portion.

7. The liquid ejecting apparatus according to claim 1, wherein the common printing operation includes a discharged liquid checking operation of checking a state of a discharged liquid storage portion for storing, as a discharged liquid, the liquid discharged from the printing portion.

8. A method for activating a liquid ejecting apparatus that executes an initial operation upon supply of power, the liquid ejecting apparatus including a printing portion configured to perform, in accordance with a print instruction, a printing operation including ejecting a liquid from a nozzle onto a medium, the initial operation and the printing operation including a common printing operation that is common to the initial operation and the printing operation, the common printing operation including one or more liquid checking operations, the method comprising:

executing the initial operation including the common printing operation when the print instruction is not received during execution of the initial operation; and omitting the common printing operation from the initial operation when the print instruction is received during execution of the initial operation, wherein the common printing operation is subsequently performed when the printing operation is performed.

9. A liquid ejecting apparatus comprising:

a printing portion that ejects a liquid from a nozzle onto a medium during a printing operation; and a control portion that executes an initial operation upon supply of power and executes the printing operation upon receipt of a print instruction, the print instruction causing the control portion to cause the printing portion to eject the liquid, wherein the initial operation and the printing operation include a common printing operation that is common to the initial operation and the printing operation, the common printing operation including one or more liquid checking operations, when the control portion does not receive the print instruction during execution of the initial operation, the control portion executes the initial operation including the common printing operation, when the control portion receives the print instruction during execution of the initial operation, the control portion omits the common printing operation from the initial operation, the common printing operation is subsequently performed when the printing operation is performed, and the common printing operation includes a discharged liquid checking operation of checking a state of a discharged liquid storage portion for storing, as a discharged liquid, the liquid discharged from the printing portion.

* * * * *